United States Patent [19]

Pfaff

[11] 4,047,953

[45] Sept. 13, 1977

[54] COLOR DIFFUSION TRANSFER EMPLOYING SILVER SALT TRANSFER REVERSAL AND 4-THIOHYDANTOINE

[75] Inventor: Maurice Edgar Pfaff, Le Perreux, France

[73] Assignee: Eastman Kodak Company, Rochester, N.Y.

[21] Appl. No.: 680,950

[22] Filed: Apr. 28, 1976

[30] Foreign Application Priority Data

May 2, 1975 France ..... 75.13774

[51] Int. Cl.[2] ..... G03C 5/54; G03C 7/00; G03C 1/48; G03C 1/40

[52] U.S. Cl. ..... 96/29 D; 96/3; 96/29 R; 96/73; 96/74; 96/76 R; 96/77; 96/107

[58] Field of Search ..... 96/3, 29 R, 29 D, 77, 96/76 R, 107, 73, 74

[56] References Cited

U.S. PATENT DOCUMENTS

| | | | |
|---|---|---|---|
| 2,346,065 | 4/1944 | Carroll et al. | 96/96 |
| 2,698,245 | 12/1954 | Land | 96/29 R |
| B 351,673 | 1/1975 | Fleckenstein et al. | 96/29 D |

FOREIGN PATENT DOCUMENTS

| | | |
|---|---|---|
| 904,364 | 8/1962 | United Kingdom |
| 972,064 | 10/1964 | United Kingdom |
| 1,428,214 | 3/1976 | United Kingdom |

*Primary Examiner*—David Klein
*Assistant Examiner*—Richard L. Schilling
*Attorney, Agent, or Firm*—R. P. Hilst

[57] ABSTRACT

The use of a 4-thiohydantoine in combination with an image-wise exposed diffusion transfer element comprising a negative silver halide emulsion layer and an associated physical development layer containing cadmium sulfide nuclei and an associated initially immobile dye-providing substance provides improved diffusion transfer dye images.

15 Claims, 1 Drawing Figure

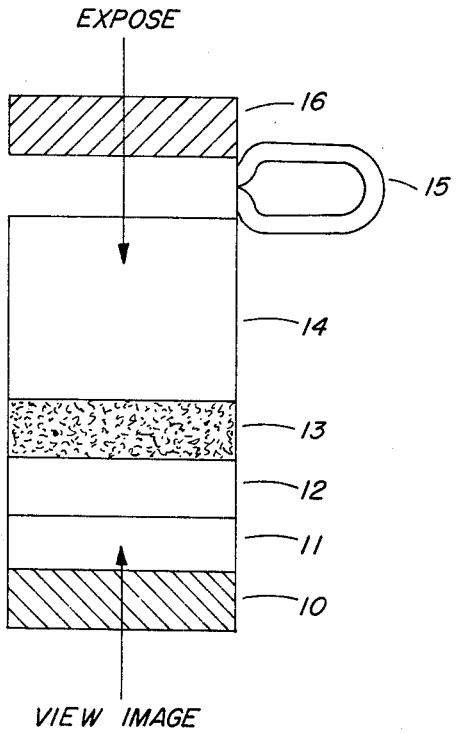
EXPOSE
16
15
14
13
12
11
10
VIEW IMAGE

COLOR DIFFUSION TRANSFER EMPLOYING SILVER SALT TRANSFER REVERSAL AND 4-THIOHYDANTOINE

FIELD OF THE INVENTION

The present invention relates to photography, particularly to a photographic process and an element for practicing it and, more particularly, the application of this process and element to diffusion transfer color photography.

BACKGROUND OF THE INVENTION

Photographic diffusion transfer processes are well known in the prior art, in particular ones that use, to form the color image, initially immobile dye providing substances capable of providing or releasing diffusible dyes or dye precursors during photographic development. Such diffusible dyes and/or dye precursors, after they have been formed, can migrate to a receiving layer where the final color image is formed.

Briefly, the formation of a color photographic image by means of such initially non-diffusing dye providing substances associated with a light-sensitive silver halide emulsion occurs as follows:

1. In a first step, an imagewise exposed and developable silver halide emulsion is developed by means of an appropriate chemical developing agent thereby obtaining formation of oxidized developing agent and metallic silver in proportion to development.

2. In a second step, the oxidized developing agent interacts with the initially immobile dye providing substance, for example, by a coupling reaction or a cross-oxidation reaction, thereby obtaining formation or release of a diffusible dye or diffusible dye precursor.

It may be observed from the above-described reaction mechanism that if a negative silver halide emulsion is used as the developable silver halide emulsion, one obtains a negative dye image with such initially immobile dye providing compounds. However, in most diffusion transfer processes, one primarily is interested in obtaining a positive dye image. For this purpose, several reversal techniques may be used.

One such reversal technique employs, not a negative emulsion, but a direct-positive emulsion, i.e., an emulsion which is developable in the unexposed areas or, more precisely, an emulsion which yields a silver image in inverse ratio to the exposure received. In this regard, U.S. Patent application Ser. No. 351,673, published Jan. 28, 1975 as Trial Voluntary Protest No. B351,673, describes various dye release compounds which contain alkali-cleavable sulfonamido groups upon oxidation thereof and which can be used in conjunction with a positive working emulsion to obtain a positive dye image.

Another such reversal technique described, for example in British Pat. No. 904,364 (page 19, lines 1–41), employs a photographic element having a negative emulsion layer and an adjacent physical development layer containing physical development nuclei and an associated dye providing substance. If, after exposure of the negative emulsion layer of such a photographic element, the element is developed with an appropriate chemical developer in the presence of a silver halide solvent, one obtains (by the now well-known silver-salt-diffusion transfer process employing the diffusion of solubilized, unexposed silver halide) the formation of a positive silver image and a positive dye image in the physical development nuclei layer. The resultant image dye is itself diffusible and therefore, for example, can migrate to a dye image receiving layer.

The aforementioned reversal technique using physical development nuclei is interesting because it makes possible the practice of a diffusion transfer process which employs a negative silver halide emulsion. Negative emulsions are less difficult to manufacture than direct-positive emulsions which are very delicate. In particular, it is difficult to manufacture direct-positive emulsions which give reproducible results, and it is especially difficult to obtain direct positive emulsions having sensitivities comparable to those of negative emulsions.

However, the above-described diffusion transfer process using physical development nuclei nevertheless has some drawbacks when applied to color diffusion transfer processes. For example, in such a process it is difficult to correctly control and correctly carry out a sequence comprising successively the step of negative emulsion development and the steps of silver salt diffusion, physical development and dye formation. In particular, it has been noted that the sensitivity of such a photosensitive element using physical development nuclei may be limited because the dissolution of the silver halide is too rapid. In other words, the silver halide solvent begins to dissolve the silver salts in the unexposed areas of the negative emulsion before the negative image has been developed. Of course, it is possible to break down the processing into two, separate operations, one operation consisting of developing the negative image in a non-solvent medium, and the other operation consisting of the physical development of the remaining unexposed silver halide in a solvent medium. However, such processing is complicated and its duration is lengthened.

Consequently, to improve the sensitivity of a diffusion transfer color photographic element employing physical development nuclei without complicating the processing thereof, it appears desirable to slightly retard or defer the dissolution of the silver salts in the negative emulsion layer. Therefore, the present invention has for one of its objects the elimination or correction of the aforementioned drawbacks as well as providing a generally improved diffusion transfer process of the type which employs a photographic element containing at least one negative silver halide emulsion layer associated with physical development nuclei and with a dye providing substance, such as a sulfonamido compound.

SUMMARY OF THE INVENTION

The process according to the invention comprises: (1) exposing a photographic element comprising at least one layer of a negative silver halide photosensitive emulsion and, associated with this layer, a physical development layer comprising cadmium sulfide nuclei and an initially immobile dye-providing substance which forms or releases a diffusible dye-providing moiety, and (2) developing this element with a chemical developing agent in the presence of a 4-thio-hydantoine, an alkaline processing medium, and a silver halide solvent. Typically, the alkaline medium and silver halide solvent are combined in a single alkaline processing composition which is then applied to the element of the present invention.

As indicated above, the present invention includes, in addition to a photographic process, a photographic element for practicing this process and its application to diffusion transfer color photography.

A photographic element of the invention comprises a base or support which carries at least one photosensitive element comprising a negative silver halide emulsion layer and an associated physical development layer containing cadmium sulfide nuclei and associated with this physical development layer the above-described initially immobile dye-providing substance. The term "associated" is used herein with reference to the arrangement of the negative silver halide emulsion, the cadmium sulfide nuclei and the dye providing substance to mean that these materials are arranged, with respect to one another, in any manner known in the art, making possible, in the presence of an appropriate chemical developer(s), alkaline processing medium and silver halide solvent, chemical development of the silver halide emulsion, the physical development of the nuclei and then the formation or release of the dye providing moiety from the dye providing substance.

In accord with a further preferred embodiment of the invention, the initially immobile dye-providing substance contains a sulfonamido group which is alkali-cleavable upon oxidation.

In particular, it has been found, according to the present invention, that the above-described use of a 4-thiohyantoine makes it possible to obtain, in a very specific manner, a considerable improvement in the sensitivity of a diffusion transfer photographic system which includes cadmium sulfide physical development nuclei. The effect obtained disappears when other physical development nuclei are used, e.g., gold or colloidal palladium nuclei.

BRIEF DESCRIPTION OF THE DRAWING

FIG. 1 is a diagrammatic cross-sectional view of a preferred color photographic film element of the invention illustrating a preferred configuration of the various components comprising such an element.

DESCRIPTION OF THE PREFERRED EMBODIMENTS

Among the various 4-thiohydantoines useful in the invention, it has been found that 5,5-dialkyl-4-thiohydantoines are especially useful. These materials have the formula:

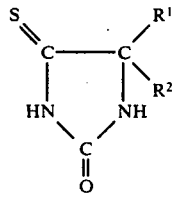

wherein $R^1$ and $R^2$ represent identical or different lower alkyl radicals having 1 to 4 carbon atoms, preferably $R^1$ and $R^2$ represent methyl or ethyl groups.

The amount of thiohydantoine making it possible to obtain the optimum improvement in accord with the invention may be determined by the man skilled in the art as a function of the other characteristics of a particular diffusion transfer system, e.g., the choice of a particular thiohydantoine, the silver halide solvent, the silver halide emulsion, or the dye providing substance. However, most often from about 0.05 g to about 1 g of thiohydantoine per mole of silver present in the negative silver halide emulsion(s) is used.

To carry out the solubilization (or complexing) of the unexposed silver halide present in the negative emulsion of the invention, known silver halide solvents (or silver halide complexing agents as these materials are sometimes called) can be used, such as alkali metal and ammonium thiosulfates, e.g., potassium thiosulfate, alkali metal and ammonium thiocyanates, as also various organic compounds, such as bis(alkylsulfonyl) methanes, e.g., bis(methylsulfonyl) methane. Such solvents are, for example, described in French Pat. No. 2,095,717. Preferably the silver halide solvent is incorporated together with the alkaline processing medium in a single processing composition for the photographic elements of the invention.

The present invention can be applied to various known systems of color photographic diffusion transfer photography. One typical embodiment of a photographic element of the invention for diffusion transfer color photography comprises a support or base, a dye image receiving layer, e.g., a layer of polymeric mordant, a reflecting layer, at least one element comprising (1) a physical development layer containing, at least in part, cadmium sulfide nuclei associated with an initially immobile dye providing substance and (2) a negative silver halide emulsion layer and an associated 4-thiohydantoine compound, means for applying the silver halide solvent and alkaline processing medium, and finally a second transparent support.

In a diffusion transfer color photographic element in accord with the invention the following image formation mechanism is believed to occur subsequent to the initial imagewise exposure of the negative silver halide emulsion of the element: The silver halide solvent and alkaline processing medium are introduced into the element and activate a chemical developing agent associated with the negative silver halide emulsion. In the exposed areas of the emulsion this developing agent develops a silver image and, as a function of this silver development, oxidized developer agent is formed. In the areas where there has been no development, the silver halide solvent dissolves unexposed silver halide which diffuses to the adjacent physical development layer containing cadmium sulfide nuclei. The solubilized silver halide which has thus diffused into the physical development layer is then physically developed by a chemical developer associated with the physical development layer in the presence of the cadmium sulfide nuclei. In the areas of the nuclei layer where this physical development takes place, oxidized developing agent is therefore formed and, where the oxidized developing agent has been formed, there occurs an interaction between this oxidized developing agent and the initially immobile dye providing substance which leads to the formation, release or splitting off of a mobile or diffusible dye providing group.

In practice, as shown in Example 1 appended hereto, the negative silver halide layer employed in a diffusion transfer color photographic element of the invention also typically has associated therewith an additional component, namely a ballasted scavenger for the oxidized chemical developer formed as a result of the development of the exposed silver halide in the negative emulsion layer. The function of this ballasted scavenger is to prevent the oxidized developer which is formed in the exposed areas of the negative emulsion layer, i.e., negative image areas of the emulsion layer, from migrating or diffusing into negative image areas of the physical development layer, i.e., areas of the physical development layer which correspond to areas of the negative emulsion layer containing exposed silver halide. If such migration of oxidized developer occurs, one may undesirably obtain production of dye (via an interaction between the oxidized developer and the dye forming substance) in the negative image areas of the physical development layer as well as the desired production of dye in the positive image areas of the physical development layer. Of course, if the particular oxidized developer formed in the negative emulsion layer is not reactive with the dye forming material present in the adjacent physical development layer, no such ballasted scavenger for oxidized developer is needed.

Where such a ballasted scavenger is employed, this material reacts with the oxidized developer to either reduce or immobilize the oxidized developer. If used, the ballasted scavenger may be located in the negative emulsion layer and/or in an interlayer, such as a gelatin interlayer, present between the negative emulsion layer and the adjacent physical development layer.

Materials useful as scavengers for oxidized developing agent in the present invention may be selected from any of a wide variety of materials which are ballasted, i.e., immobile, and which are capable of reacting with the oxidized developer. Such materials include, for example, ballasted hydroquinones such as described in U.S. Pat. Nos. 2,360,290; 2,403,721; 2,701,197; and 3,700,453; and ballasted coupling agents such as those described in U.S. Pat. Nos. 2,474,293 and 3,770,431; German Pat. OLS No. 2,123,268; and those ballasted of "non-diffusing" couplers referred to on page 19 of British Pat. No. 904,364. The ballast group of the ballasted scavenger, as will be apparent to those skilled in the art, may be any group whose molecular size and configuration is such that the material to which it is attached is rendered immobile in the colloid layers of the photographic elements of the invention. Typical ballast groups include long-chain alkyl radicals linked directly or indirectly to the scavenger molecule, as well as aromatic radicals of the benzene and naphthalene series, etc., linked directly or indirectly to the scavenger molecule by a removable or irremovable but otherwise nonfunctional linkage depending upon the nature of the scavenger compound. Generally, useful ballast groups have at least 8 carbon atoms.

The term "mobile" is used herein to refer to the ability of a compound to diffuse or to migrate through the hydrophilic colloid layers which comprise a photographic element, in the presence of an alkaline medium, either due to the intrinsic diffusing properties of this compound, or because its molecule carries one or more solubilizing groups such as —COOH,—$SO_3H$,—$SO_2NH_2$,—$SO_2CH_3$,—OH, etc. The term "diffusible" is used herein interchangeably with the term "mobile". The terms "immobile" or "non-diffusible" are also used interchangeably herein and are defined to have a meaning opposite "mobile".

As a result of the above-described image formation mechanism there is formed a diffusible image composed of the dye providing moiety, at least a part of which diffuses to the dye image receiving layer to form a positive dye image.

The dye image forming substance may be any substance capable of interacting with the oxidation product of a developing agent to form or to release a dye or a dye precursor. Typically, the dye image forming substance associated with the physical development layer is an initially immobile or nondiffusible substance having linked thereto a splittable dye or dye precursor which is diffusible. The substance is rendered immobile or nondiffusible by the presence of one or more ballast groups of the type well-known in the art, the ballast group by virtue of its molecular size and/or configuration rendering the substance immobile in the photographic element of the invention. The dye or dye precursor upon release from the initially immobile dye providing substance is typically mobile or diffusible and therefore capable of migrating through the various photographic layers of the photographic element to the dye image receiving layer. Various image forming substances useful in the invention are well known and include, for example, the image transfer couplers described in U.S. Pat. Nos. 3,148,062; 3,227,551; 3,227,554 and 3,765,886; alkali-cleavable dye release compounds such as the sulfonamido group containing compounds noted above and described in U.S. application Ser. No. 351,673 published Jan. 28, 1975 and other redox dye release compounds such as those described in U.S. Pat. Nos. 3,932,380 and 3,929,760; ring closure compounds such as those described in U.S. Pat. Nos. 3,443,940 and 3,734,726; sulfonyl hydrazones and related compounds such as those described in U.S. Pat. Nos. 3,628,952 and 3,844,785; ballasted dye-releasing hydroquinones and related compounds such as those described in U.S. Pat. Nos. 3,698,897; 3,725,062 and 3,728,113; etc. These substances normally give a negative dye image when they are associated with the development of a negative image in a conventional negative emulsion. However, the use of these dye forming substances in association with the physical development layer(s) used in the elements of the invention makes it possible to obtain a positive dye image from the exposure of a conventional negative emulsion.

In accord with a particularly advantageous embodiment of the invention, sulfonamido group-containing compounds, such as the sulfonamidophenols described in published U.S. application Ser. No. 351,673, are used as the dye image forming substance. In this case, the mechanism of formation of the color image in the physical development layer may be schematized as follows:

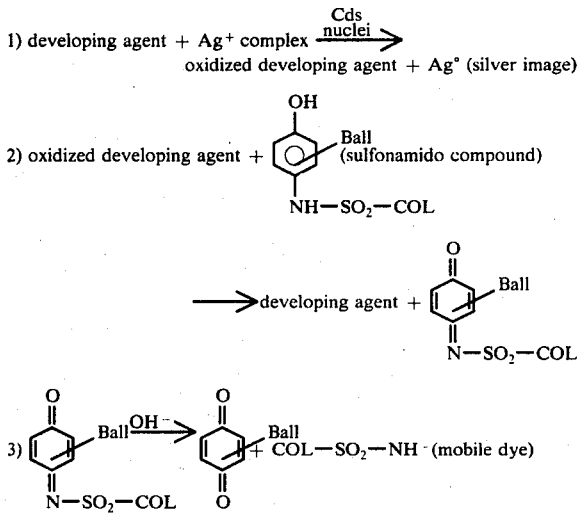

wherein COL represents a dye radical and Ball a radical whose molecular size and configuration is such that the sulfonamidophenyl, as also the quinonic residue thereof, are immobile in the colloid layers of the photographic elements of the invention.

With respect to the developing agents used to obtain development in the negative emulsion layer and in the physical development layer of the photographic elements of the invention, useful developing agents may be selected from a variety of such materials well known in the art. For example, in a color photographic element of the invention when the dye forming substance is a color forming coupler, a primary aromatic amine such as a paraphenylenediamine or a para-aminophenyl color developing agent can be chosen for use in association with the physical developer layer; when the color forming substance is one that releases the image forming dye by a non-coupling cleavage reaction, e.g., a sulfonamido compound, a developing agent is chosen which, when oxidized, is capable of undergoing cross-oxidation with this sulfonamido compound in the presence of a silver halide solvent. As will be apparent, the particular chemical developer selected for use in association with the physical development layer is chosen such that the oxidized form of the developer is capable of entering into a dye forming or dye releasing reaction with the particular dye providing substance associated with the physical development layer. Thus, the selection of a particular chemical developer for use in association with the physical developer layer depends in large part on the particular dye-providing substance which is employed. Among other useful developing agents, the following may be cited:

Hydroquinone,
N-methylaminophenyl,
Phenidone, a tradename for 1-phenyl-3-pyrazolidone,
Dimezone, a tradename for 1-phenyl-4,4-dimethyl-3-pyrazolidone,
1,2-dihydroxybenzene(catechol)
Aminophenols,
N,N-diethyl-p-phenylenediamine,
3-Methyl-N,N-diethyl-p-phenylenediamine,
3-Methoxy-N-ethyl-N-ethoxy-p-phenylenediamine,
4-Hydroxymethyl-4-methyl-1-phenyl-3-pyrazolidone, etc.

The developing agent may be present either in the photosensitive element, or in the processing composition, or in both. However, it is preferred to incorporate the developing agent in the photosensitive element. According to one embodiment, a first developing agent is used in the negative emulsion layer, and a second developing agent is used in the adjacent physical development layer. The first developing agent is selected according to its activity to avoid too active compounds that would cause an overdevelopment of the negative layer; the second developing agent is chosen from among the compounds capable of reacting with the dye forming substance, i.e., for example, capable of undergoing cross-oxidation with a sulfonamido compound in the presence of the silver halide solvent. In this embodiment of the invention, the first developing agent is advantageously chosen from among the class of para-aminophenols; and, when a sulfonamido dye forming substance is used, the second developing agent is advantageously chosen from among the class of pyrazolidones.

In accord with a particularly advantageous embodiment of the invention, there is provided a photographic element for diffusion transfer color photography as described above in which the means to introduce a preferably viscous alkaline processing solution is a rupturable pod. Cameras designed to use such color photographic film elements include means permitting a rapid access to the developed print and are equipped with members, so that during the extraction of the photographic film element from the camera, after exposure, the pod is crushed and its content is injected inside the film element. The dye image receiving layer of such a film element may be contacted against the element after the exposure of the latter. Then after a predetermined time of contact in the presence of the viscous alkaline processing solution, the dye receiving layer may be separated from the film element. The dye receiving layer may also be a part of the photographic element in a permanent manner, i.e., after obtaining the image on the receiving layer, the latter is not separated from the rest of the film element. In the latter case, the photographic film element is referred to as "integral no-peel-apart". Such no-peel-apart materials are described, for example, in French Pat. Nos. 2,065,875 and 2,099,015.

The attached drawing, FIG. 1 represents a preferred embodiment of a diffusion transfer color photographic element of the invention.

This integral film unit comprises a transparent base 10, a receiving layer 11, a reflecting layer 12 containing a white pigment such as titanium dioxide, barium sulfate, zinc oxide, etc.; an opaque layer 13 containing a black pigment, e.g. carbon black; a photosensitive element 14 comprising the various silver halide emulsion layers sensitive, respectively, to the blue, green and red regions of the spectrum, physical development layers and associated dye forming substances according to the invention; a cover sheet 16; and a rupturable pod 15 which contains a silver halide solvent, a viscous, alkaline composition, an opacifying agent such as carbon black; and, optionally, a developing agent (if one is not incorporated in a layer of the composite film unit) and an antifogging agent (also optional). Of course, the integral film unit of FIG. 1 can also comprise interlayers, or neutralizing and timing layers as described below. The unit is exposed through cover sheet 16 and the transfer image is viewed through the transparent base 10, against the white background of the reflecting layer 12.

As an example, the photosensitive element 14 comprises, in sequence from the side which is the farthest from the base 10, a blue-sensitive silver halide emulsion layer; a physical development layer containing a dispersion of cadmium sulfide nuclei and a yellow-dye-image-forming substance; an interlayer; a green-sensitive silver halide emulsion layer; a physical development layer containing a dispersion of cadmium sulfide nuclei and a magenta-dye-image-forming substance; an interlayer; a red-sensitive silver halide emulsion layer; a physical development layer containing a dispersion of cadmium sulfide nuclei and a cyan-dye-image-forming substance.

The initially immobile dye-image-providing substances used in the invention may be incorporated in various manners in the photographic elements. They may be dispersed in the form of a slightly alkaline aqueous solution in the hydrophilic colloids used to form the physical development layers when the dye forming substances contain solubilizing groups. Alternatively, other techniques for incorporating the dye forming substances may be used when the substances are predominantly organophilic, i.e., when they contain no or weak solubilizing groups. A preferred technique consists of dissolving the substances in a high-boiling solvent, such as tricresyl phosphate or like compounds described in U.S. Pat. No. 2,322,027 and then dispersing the resulting solution in the hydrophilic colloid of the physical development layer.

The various negative silver halide emulsion layers used in a color photographic element of the invention may be positioned in the usual sequence; that is, with respect to the exposure side of the element, there is first placed the blue-sensitive silver halide emulsion layer, then the green-sensitive layer, and then, on the bottom, the red-sensitive layer. If desired, a yellow dye layer or a Carey Lea silver emulsion layer may be disposed between the blue-sensitive emulsion layer and the green-sensitive layer to absorb or filter blue light radiation that might be transmitted through the blue-sensitive emulsion layer. However, if desired, the selectively sensitized emulsions may be disposed in a different order; for example, with respect to the exposure side, first the blue-sensitive layer, then the red-sensitive layer, and then the green-sensitive layer.

The receiving layer of the photographic element of the invention contains, in general, any substance capable of mordanting or fixing the transferred dye. According to one embodiment, the receiving layer may contain a polymeric mordant; if the transferred dye comprises acid solubilizing groups, a basic mordant is chosen, e.g., a polymer containing atoms of quaternary nitrogen, such as those disclosed in U.S. Pat. Nos. 2,882,156; 2,484,430; 3,271,147 or 3,271,148. The receiving layer may have a dry thickness of from about 6 microns to about 10 microns, and it may contain various addenda, such as optical brightening agents, or compounds intended to protect the image against ultraviolet light.

The rupturable pod used according to the invention may be of the type described in U.S. Pat. Nos. 2,543,181; 2,643,886; 2,563,732; 2,723,051; 3,056,491 and 3,152,515. Generally, such pods are composed of a rectangular sheet of a material impervious to air and fluids, such rectangular sheet material being folded longitudinally on itself so as to form two walls which are sealed to each other along their longitudinal and lateral edges. A container is thus formed to contain the processing solution.

In general, the silver halide emulsion layers of the photographic elements of the invention are composed of photosensitive silver halides dispersed in gelatin and their dry thickness is between about 0.6 micron and about 6 microns. The dye image forming substances used in the invention are dispersed in polymeric, aqueous alkaline permeable, binder layers, such as gelatin, the dry thickness of such layers being from about 1 micron to about 7 microns. The intermediate layers of polymers permeable to alkaline solutions, e.g., gelatin layers, have a dry thickness of from about 1 micron to about 5 microns. Of course, the values given for the thickness of the layers are approximate and can be modified according to the particular photographic element desired.

The stability of the transferred dye image may be increased by associating a neutralizing substance such as an acid polymer with the dye image receiving layer. In general, this neutralizing substance makes it possible to reduce the pH of the image layer from an initial value of 13 or 14 to at least a value of 11 and, preferably, to a value between about 5 and about 8. This reduction in pH occurs in a short time after the impregnation of the processing composition into the photographic elements of the invention. For example, acid polymers may be used such as described in French Pat. No. 1,380,778 or metallic salts, e.g., zinc acetate, zinc sulfate, magnesium acetate, or zinc, aluminum, iron, manganese, cobalt or nickel formates, acetates, propionates, stearates or sulfates, etc,; acids in a solid form may also be used, such as described in U.S. Pat. No. 2,584,030. Such neutralizing substances reduce the pH within the photographic element of the invention following the development process so as to terminate this development and to substantially reduce any transfer of dye after this development, thus permitting stabilization of the dye image.

A timing layer or spacer layer may also be used which is placed over the pH reducing layer to "time" or control the pH reduction of the photographic element as a function of the speed with which the alkali diffuses through this inert spacer layer. Examples of such timing layers comprise gelatin, polyvinyl alcohol, or any of the substances mentioned in U.S. Pat. No. 3,455,686. The timing layer is also effective in evening out the various reaction rates over a wide range of temperatures, e.g., premature pH reduction is prevented when imbibition is effected at temperatures above room temperature, for example, at 35° to 38° C. The timing layer is usually about 2.5 microns to about 18 microns in dry thickness. Especially good results are obtained when the timing layer comprises a hydrolyzable polymer or a mixture of such polymers which are slowly hydrolyzed by the processing composition. Examples of such hydrolyzable polymers include polyvinyl alcohol, polyvinyl acetate, polyamides, polyvinyl ethers, partial acetals of polyvinyl alcohol, etc.

The alkaline processing medium employed in this invention contains, in addition to the silver halide solvent (if this material is incorporated in the alkaline processing composition), a conventional aqueous solution of an alkaline material, e.g., sodium hydroxide, sodium carbonate or an amine such as diethylamine, preferably possessing a pH in excess of 12. Preferably, the processing composition also contains a viscosity-increasing agent such as a soluble, high molecular weight polymer, e.g., a cellulose derivative soluble in water and inert in regard to alkaline solutions such as hydroxyethylcellulose or the salts of alkali metal and carboxymethylcellulose, e.g., sodium carboxymethylcellulose. An amount of viscosity-increasing agent representing from about 1% to about 5% by weight of the processing composition is preferred and such amounts impart the processing a viscosity of about 100 cps. to about 200,000 cps. In some cases, an opacifying agent, such as commercially available titanium dioxide ($TiO_2$) or carbon black, may be added to the processing composition.

The alkaline processing composition and/or silver halide solvent used for practicing the present invention can be applied from a rupturable pod as indicated above, but other techniques may be used for applying the processing composition and/or solvent; for example, the photosensitive element may be dipped in a processing solution or the processing composition and/or solvent may be injected by means similar to hypodermic syringes that are fastened either to a camera or to a camera cartridge containing a photosensitive film element of the invention.

The transparent supports of the photographic elements according to the invention may be composed of any substance, provided that this substance does not alter the photographic properties of the film element and provided further that these substances make it possible to obtain supports having good dimensional stability. Typical flexible, transparent sheet support materials include cellulose nitrate films, polystyrene films, poly-(ethylene terephthalate), polycarbonate, poly-alphaolefin films, e.g., polyethylene or polypropylene, as also the films made of other resinous substances as well as glass. The dry thickness of the supports is generally between about 50 microns and about 150 microns.

While the invention has been described with reference to layers of silver halide emulsions and dye image-providing materials, dotwise coating, such as would be obtained using a gravure printing technique, could also be employed. In this technique, small dots of blue, green and red-sensitive emulsions have associated therewith, respectively, dots of yellow, magenta and cyan color-providing substances. After development, the transferred dyes would tend to fuse together into a continuous tone.

The following examples illustrate the invention.

EXAMPLE 1

This example is a comparative example. A control film element was prepared which had the following structure. On a transparent cellulose triacetate base were successively coated:

1. a blue-sensitive negative-working silver bromoiodide emulsion comprising per dm², 10 mg of silver, 29 mg of di-octylhydroquinone, 25 mg of gelatin and 0.5 mg of the developing agent p-methylaminophenolsulfate, known also under the tradename Elon;

2. a layer comprising per dm², 0.15 mg of cadmium sulfide nuclei, 15 mg of gelatin, 0.3 mg of the black and white developing agent 4,4-dimethyl-n-phenylpyrazolidone, known also under the tradename Dimezone and, finally, 16 mg of a sulfonamido compound having formula I given below;

3. an intermediate layer comprising per dm², 1 mg of colloidal silver (Carey Lea silver), 16.5 gm of di-octylhydroquinone and 10 mg of gelatin;

4. a green-sensitive negative-working silver bromoiodide emulsion layer comprising per dm², 10 mg of silver, 29 mg of di-octylhydroquinone, 0.5 mg of Elon and 25 mg of gelatin;

5. a layer comprising per dm², 0.15 mg of cadmium sulfide nuclei, 15 mg of gelatin, 0.3 mg of Dimezone, and 16 mg of the sulfonamido compound of formula II below;

6. an intermediate layer the composition of which is identical with that of layer No. 3;

7. a red-sensitive negative-working silver bromoiodide emulsion layer comprising per dm², 10 mg of silver, 25 mg of gelatin, 0.5 mg of Elon and 29 mg of di-octylhydroquinone;

8. a layer comprising per dm², 0.15 mg of cadmium sulfide nuclei, 15 mg of gelatin, 0.3 mg of Dimezone and 16 mg of the sulfonamido compound having formula III given below.

The emulsions used in layers No. 1, 4 and 7, were silver bromoiodide emulsion chemically sensitized with sulfur and gold and having a photographic sensitivity of about 20 ASA.

Samples of this film element were exposed through the transparent base through a colored density scale, so as to record the response of the element respectively to an exposure to blue light, to green light and to red light.

After exposure, there was applied on the surface of each sample of the film element which is the farthest from the transparent base, an image receiving element composed of a support bearing a mordanting layer, namely a paper support bearing a layer containing per dm², 10 mg of gelatin and 20 mg of a copolymer of styrene and N-benzyl-N,N-dimethyl-N-(3-maleimidopropyl)ammonium chloride.

Between the image receiving element and the exposed film element, there was spread the following processing composition:

| | |
|---|---|
| KOH | 100 g |
| Bis(methylsulfonyl)methane | 20 g |
| Hydroxyethylcellulose | 20 g |
| Water to make | 1 liter |

After separating the image receiving elements, the characteristics of the transferred image were recorded in the Table below.

EXAMPLE 2

The procedure of Example 1 was repeated, i.e., a multilayer photosensitive film element was prepared, having a structure identical with that of Example 1, except that in each silver halide emulsion layer, there was introduced 0.5 g of 5-methyl-5-ethyl-4-thiohydantoine per mole of silver. The film element was exposed and processed according to the procedure indicated in Example 1 and the results mentioned in the Table below were obtained.

Table

| | Exposure to blue | | Exposure to green | | Exposure to red | |
|---|---|---|---|---|---|---|
| | sensitivity | Dmax | sensitivity | Dmax | sensitivity | Dmax |
| Example 1 Control | So * | 1.92 | −0.10 | 2.04 | −0.20 | 1.55 |
| Example 2 | +0.70 | 1.92 | +0.40 | 1.80 | +0.50 | 1.70 |

* The sensitivity to blue of the control is taken as a reference (So); the differences obtained with the other tests are expressed in Log E. It is noted, therefore, that the use of 4-thiohydantoine made it possible to obtain a considerable gain of sensitivity, because, e.g., for the exposure to blue, a gain of 0.70 Log E was noted, which is equivalent to a 5X increase in sensitivity over the control sensitivity (So).

Formule I

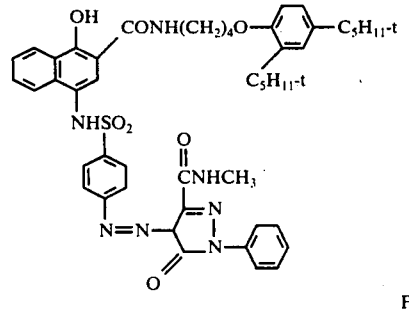

Formule II

-continued

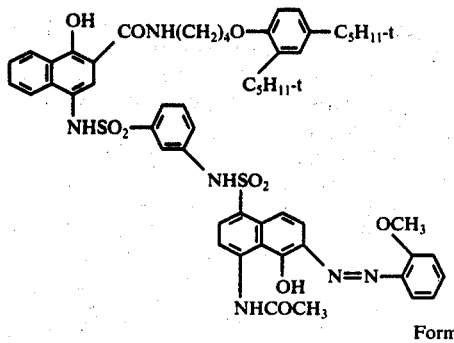

Formule III

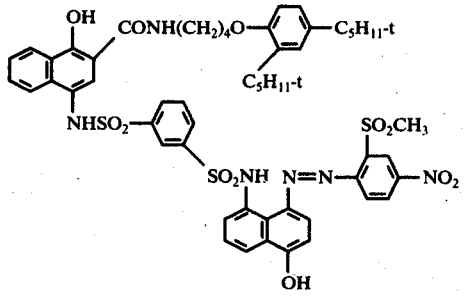

The invention has been described in detail with particular reference to certain preferred embodiments thereof, but it will be understood that variations and modifications can be effected within the spirit and scope of the invention.

I claim:

1. A photographic diffusion transfer element for producing a dye or dye precursor image, said element comprising a support bearing at least one element comprising a. a negative silver halide emulsion having associated therewith a 4-thiohydantoine and a ballasted scavenger for oxidized chemical developing agent and b. a physical development layer comprising cadmium sulfide nuclei and an initially immobile dye-providing substance which can provide diffusible dye or dye precursor.

2. A photographic diffusion transfer element as defined in claim 1 wherein said 4-thiohydantoine is a 5,5-dialkyl-4-thiohydantoine.

3. A photographic diffusion transfer element for producing a dye or dye precursor image, said element comprising a support bearing at least one element comprising a. a negative silver halide emulsion containing a 4-thiohydantoine and having associated with said emulsion a chemical developing agent and a ballasted scavenger for oxidized chemical developing agent and b. a physical development layer associated with said emulsion layer, said physical development layer comprising cadmium sulfide nuclei, an initially immobile dye providing substance which can provide diffusible dye or dye precursor, and, associated with said physical development layer, a chemical developing agent.

4. A photographic diffusion transfer element as defined in claim 3 wherein said 4-thiohydantoine has the formula

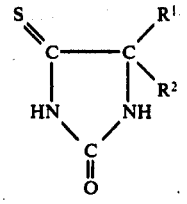

wherein each of $R^1$ and $R^2$ represent the same or different lower alkyl radicals having 1 to 4 carbon atoms.

5. A photographic diffusion transfer element as defined in claim 3 wherein said initially immobile dye providing substance contains a sulfonamido group which is alkali cleavable upon oxidation.

6. A photographic diffusion transfer film unit for producing a dye or dye precursor image, said unit comprising 1. a support bearing at least one element comprising
   a. a negative silver halide emulsion containing a 4-thiohydantoine and having associated with said emulsion a chemical developing agent and a ballasted scavenger for oxidized chemical developing agent and
   b. a physical development layer associated with said emulsion layer, said physical development layer comprising cadmium sulfide nuclei, an initially immobile dye-providing substance which can provide diffusible dye or dye precursor, and, associated with said physical development layer, a chemical developing agent, and
2. means for applying an alkaline processing medium and a silver halide solvent to the surface of said negative silver halide emulsion layer.

7. A photographic diffusion transfer film unit as defined in claim 6 wherein said film unit comprises three of said elements, each of said three elements containing a negative silver halide emulsion layer sensitive to a different region of the visible spectrum and each of said elements containing an initially immobile dye-providing substance associated with said physical development layers thereof, the immobile dye-providing substance contained in each of said elements containing a dye or dye precursor having or providing a different color.

8. A photographic diffusion transfer film unit according to claim 6 wherein said silver halide solvent is selected from the group consisting of an alkali metal or ammonium thiosulfate, an alkali metal or ammonium thiocyanate, or a bis(alkylsulfonyl)methane and wherein said 4-thiohydantoine is a 5,5-dialkyl-4-thiohydantoine.

9. A photographic diffusion transfer film unit according to claim 6 wherein said initially immobile dye-providing substance contains a sulfonamido group which is alkali cleavable upon oxidation.

10. A photographic diffusion transfer film unit for producing a multicolor dye image, said unit comprising a support bearing a dye image receiving layer, a reflecting layer, red; green; and blue light-sensitive elements capable of producing cyan, magenta, and yellow dye images in response to red, green, and blue light radiation, respectively, and overlying said three light-sensitive elements a rupturable pod containing a liquid processing composition comprising a silver halide solvent and an alkaline processing medium, 1. said red light sensitive element comprising a. a negative silver halide emulsion layer sensitive to red light having associated therewith a chemical developing agent, a ballasted scavenger for oxidized chemical developing agent, and, incorporated in said emulsion layer, a 5,5-dialkyl-4-thiohydantoine and b. a physical development layer associated with said emulsion layer, said physical development layer comprising cadmium sulfide nuclei, an initially immobile dye-providing substance which can provide diffusible dye or dye precursor, and, associated with said physical development layer, a chemical developing agent, said physical development layer located between said support and said negative emulsion layer sensitive to red light, 2. said green light sensitive element comprising a. a negative silver halide emulsion sensitive to green light having associated therewith a chemical developing agent, a ballasted scavenger for oxidized chemical developing agent, and, having incorporated in said emulsion layer a 5,5-dialkyl-4-thiohydantoine and b. a physical development layer associated with said emulsion layer, said physical development layer comprising cadmium sulfide nuclei, an initially immobile dye-providing substance which can provide diffusible dye or dye precursor, and, associated with said physical development layer, a chemical developing agent, said physical development layer located between said support and said negative emulsion layer sensitive to green light, and 3. said blue light sensitive element comprising a. a negative silver halide emulsion layer sensitive to blue light having associated therewith a chemical developing agent, a ballasted scavenger for oxidized chemical developing agent, and, having incorporated in said emulsion layer, a 5,5-dialkyl-4-thiohydantoine and b. a physical development layer associated with said emulsion layer, said physical development layer comprising cadmium sulfide nuclei, an initially immobile dye-providing substance which can provide diffusible dye or dye precursor, and, associated with said physical development layer, a chemical developing agent, said physical development layer located between said support and said negative emulsion layer sensitive to blue light.

11. A photographic diffusion transfer film unit as defined in claim 10 wherein said silver halide solvent is selected from the group consisting of an alkali metal or ammonium thiosulfate, an alkali metal or ammonium thiocyanate, and a bis(alkylsulfonyl)methane and wherein said initially immobile dye-providing substance which is contained in each of said red, green, and blue light sensitive elements contains a sulfonamido group which is alkali cleavable on oxidation.

12. A photographic diffusion transfer film unit as defined in claim 10 wherein said unit includes a cover sheet overlying said rupturable pod, said cover sheet comprising a neutralizing layer capable of reducing the pH of the resultant film unit subsequent to diffusion therethrough by said alkaline processing medium and a timing layer associated with said neutralizing layer to control the pH reduction of the film unit.

13. In a photographic diffusion transfer process for producing a dye or dye precursor image in a photographic element and transferring said image to an image receiving layer, said element including a support bearing at least one element comprising 1. a negative silver halide emulsion layer having associated therewith a ballasted scavenger for oxidized chemical developing agent and 2. a physical development layer comprising cadmium sulfide nuclei and an initially immobile dye-providing substance which provides diffusible dye or dye precursor, said process including a. image-wise exposing said negative emulsion layer b. developing said negative emulsion layer with a chemical developing agent in the presence of an alkaline processing medium and a silver halide solvent, whereby unexposed silver halide in said negative emulsion is solubilized and diffuses into said physical development layer, c. physically developing said solubilized silver halide in said physical development layer in the presence of a chemical developing agent to obtain oxidized chemical developer which interacts with said initially immobile dye providing substance thereby producing a diffusible dye or dye precursor image, and d. transferring said diffusible dye or dye precursor image to said image receiving layer, the improvement which comprises carrying out step (b) of said process in the presence of a 4-thiohydantoine.

14. A photographic diffusion transfer process as defined in claim 13 wherein said 4-thiohydantoine is a 5,5-dialkyl-4-thiohydantoine.

15. A photographic diffusion transfer process as defined in claim 13 wherein said 4-thiohydantoine has the formula

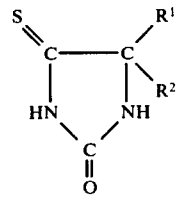

wherein each of $R^1$ and $R^2$ represent the same or different lower alkyl radicals having 1 to 4 carbon atoms.

* * * * *